United States Patent [19]

Vowles

[11] Patent Number: 4,852,529

[45] Date of Patent: Aug. 1, 1989

[54] LASER ENERGY IGNITION SYSTEM

[75] Inventor: Robert W. Vowles, North Melbourne, Australia

[73] Assignee: Bennett Automotive Technology Pty. Ltd., Melbourne, Australia

[21] Appl. No.: 156,916

[22] PCT Filed: Mar. 6, 1987

[86] PCT No.: PCT/AU87/00063

§ 371 Date: Nov. 6, 1987

§ 102(e) Date: Nov. 6, 1987

[87] PCT Pub. No.: WO87/05364

PCT Pub. Date: Sep. 11, 1987

[30] Foreign Application Priority Data

Mar. 7, 1986 [AU] Australia ..... PH04930

[51] Int. Cl.[4] ..... F02P 23/00

[52] U.S. Cl. ..... 123/143 B; 123/143 R

[58] Field of Search ..... 123/143 B, 143 R; 431/1, 258

[56] References Cited

U.S. PATENT DOCUMENTS

| | | | |
|---|---|---|---|
| 3,473,879 | 10/1969 | Berberich | 123/143 B |
| 3,861,371 | 1/1975 | Gamell | 123/143 B |
| 4,314,530 | 2/1982 | Giacchetti | 123/143 B |
| 4,416,226 | 11/1983 | Nishida et al. | 123/143 B |
| 4,434,753 | 3/1984 | Mukainakano et al. | 123/143 B |

FOREIGN PATENT DOCUMENTS

| | | | |
|---|---|---|---|
| 0087861 | 7/1980 | Japan | 123/143 B |
| 0162773 | 9/1983 | Japan | 123/143 B |
| 0019576 | 11/1983 | Japan | 123/143 B |
| 1202125 | 8/1970 | United Kingdom | 123/143 B |

*Primary Examiner*—Raymond A. Nelli

*Attorney, Agent, or Firm*—Dorsey & Whitney

[57] ABSTRACT

An ignition system for internal combustion engines which minimizes or eliminates problems associated with conventional spark ignition arrangements, the ignition system comprises a laser energy generator (9) which is arranged to supply laser energy continuously at an energy level less than that needed to initiate combustion with the energy level being spiked in timed sequence and delivered to the combustion chambers (35) of the engine, the system further including optic means (39) for focussing the pulsed laser energy at predetermined points within the combustion chambers whereby the focussed laser energy is sufficient to ignite any combustible charge within the combustion chambers, the pulsed laser energy being deliverd through a purging chamber (12) to the respective combustion chambers with a purging gas being continuously supplied to the purging chamber (12) to prevent combustion gases flowing towards the laser optic means (39).

13 Claims, 2 Drawing Sheets

LASER ENERGY IGNITION SYSTEM

The invention relates to an improved ignition system for liquid and gaseous-fuelled internal combustion engines.

Existing ignition systems rely for ignition upon the generation of a high-tension current which is momentarily applied across some form of air spark gap. In the Kettering system, the usual form of automative ignition systems, the said high-tension current is generated in the secondary windings of a transformer by the interruption of a low voltage current across its primary windings and transmitted to remotely located spark gaps by means of suitable conductors. In some so-called automotive high-energy applications and in the case of gas turbines, storage devices may be provided for the high tension current. In the case of multi-cylinder automotive use, a conductor passes from the transformer to a mechanical distributor and thence by means of individual conductors to a spark gap in each combustion chamber. In this type of ignition system, it is necessary to apply relatively high current levels at the transformer to achieve a suitable discharge at the spark gap, after allowing for resistance and discharge losses in the high tension conductors. Additionally, radio-frequency energy is generated at the spark gap by the spark discharge, at the breaker points in a Kettering type automotive ignition system, and may also be radiated from the high tension conductors.

Where such an ignition system is operated in proximity to sensitive equipment, this radio frequency energy must be suitably screened. In practice, it is frequently found that malfunction or inefficient operation of such ignition systems occurs because of breakdown of the insulation of conductors, ingress of moisture into system components, erosion of the spark gap electrodes, fouling of the spark gap by combustion products resulting from excessive oil consumption or incorrect mixture strength and, in the case of the Kettering system, high resistance in the breaker points caused by their oxidation. The correct type of sparking plug must be installed for the particular mode of service to which the engine is put. The cleaning, adjustment and replacement of components forms part of the regular maintenance of conventional ignition systems.

Spark discharge ignition for diesel or heavy oil-fuelled engines has not proved a practical proposition. High voltages and lethal current flows have been necessary, resulting in a very short service life for igniters. The timing of ignition in compression ignition oil-fuelled engines currently depends upon the rate of adiabatic temperature rise and the amount of mechanical turbulence present in the cylinder, fuel droplet size and the cetane number of fuel. Gas turbine engines also employ high voltages and current flows in their starting ignition systems and their spark discharge igniters have relatively short service lives.

The object of the present invention is to provide an ignition system for liquid or gaseous-fuelled combustion engines, which will provide optimum ignition over the operational life of an engine without the need for periodical maintenance.

Further preferred objectives of the present invention include:

(i) providing an ignition system which will operate with a current drain substantially less than that of conventional systems, (ii) avoiding the problems with insulation failure and water shorting to which conventional systems are subject;

(iii) minimizing the generation of radio frequency energy;

(iv) providing an ignition system which will allow the early injection and ignition of oil fuel in diesel engines; and (v) providing an ignition system for gas turbine engines conferring greater reliability and a substantial reduction in maintenance requirements.

According to a first aspect of the present invention there is provided an ignition system for an internal combustion engine, said system including laser energy generating means for generating pulsed laser energy, control means for delivering a pulse of said laser energy at predetermined desired time intervals to a combustion chamber, and means for concentrating said pulsed laser energy at a predetermined location within said combustion chamber, such that focussed laser energy formed by said means for concentrating the pulsed laser energy is sufficient to cause ignition of a combustible charge within said chamber. Conveniently, the laser energy generating means generates laser energy continuously at a level below that required to effect ignition in the combustion chamber, and the energy output of the said laser energy generating means being spiked at each point in time when ignition is required.

According to a second aspect of the present invention there is provided an ignition system for an internal combustion engine, said system including laser energy generating means for generating pulsed laser energy in response to control means for delivering laser energy pulses of desired level in timed sequence to a combustion chamber, said laser energy pulses being delivered to said combustion chamber through purging chamber opening into said combustion chamber, said purging chamber having a continuous flow of purging gas supplied thereto during operation of said engine. Conveniently said purging gas is air pressurized to a level substantially equivalent to the maximum pressure generated by combustion within said combustion chamber. Preferably the gas or air is highly filtered and cleaned before introduction into the purging chamber.

In a preferred embodiment, the laser energy generating means provides a continuous output of laser energy below that required to effect ignition, said output being spiked as required to initiate ignition, and lens means are provided for concentrating the pulsed laser energy at a predetermined location within the combustion chamber. In one possible preferred embodiment, a single laser energy generating means might be used with appropriate distribution means to transfer the generated laser energy pulses to individual combustion chambers. Alternatively a form of laser energy generation might be provided for each combustion chamber.

The nature of the present invention will be more readily understood from the following brief description of preferred embodiments given in relation to the accompanying drawings, in which.

Figure 1:
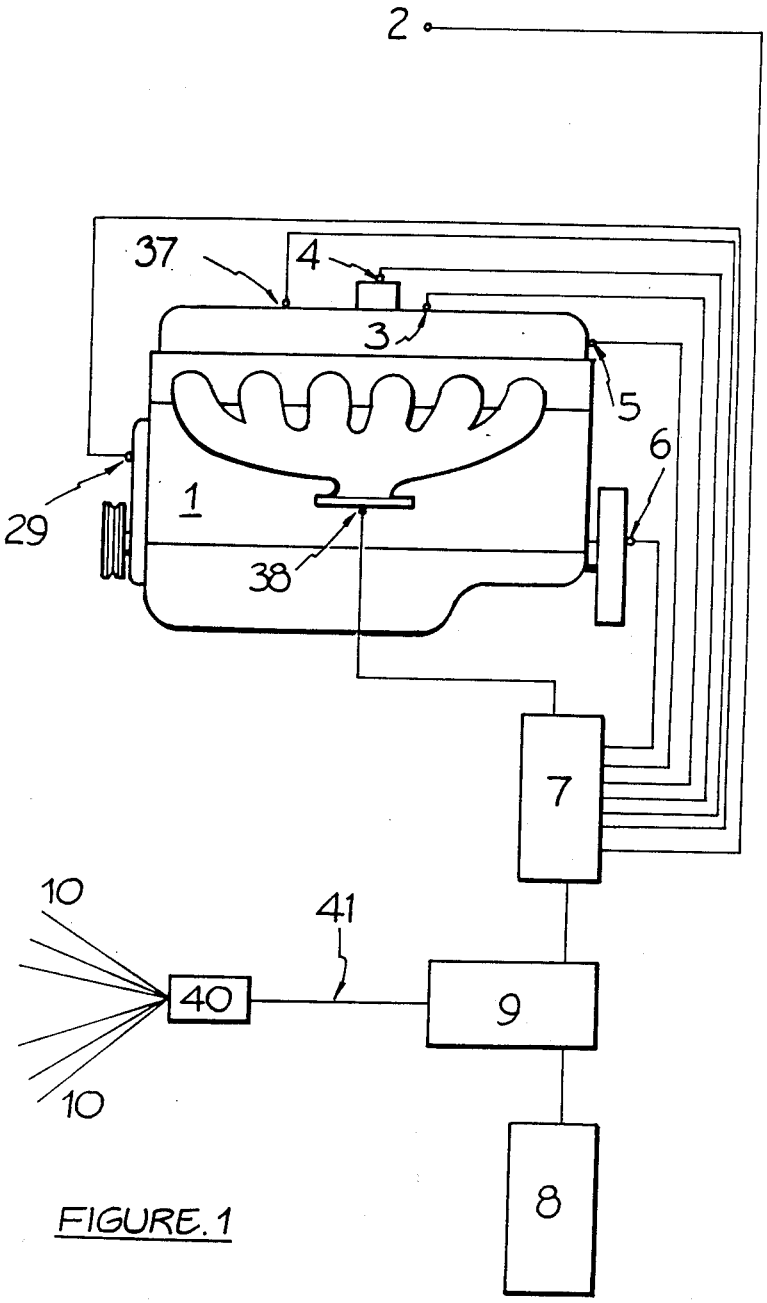
FIG. 1 is a block diagram of a typical preferred arrangement of an ignition system according to the present invention.

According to FIG. 1, an engine 1 is provided with sensor 2 which detects engine compartment air temperature, sensor 3 which detects throttle position, sensor 4 which detects manifold air pressure, sensor 5 which detects cylinder head temperature, sensor 6 which detects instantaneous crankshaft angular velocity and thus crank angle, sensor 29 which reads an ignition reference datum on a rotating element of the camshaft, sensor 37 which detects detonation-induced vibrations in the induction system, and sensor 38 which detects exhaust gas oxygen level. In the preferred embodiment of the invention, crankshaft rotational data is gathered from the engine by short-range Hall Effect devices 6 and 29 which read, respectively magnetic variations caused within their sensing fields by the passage of the teeth of the fly-wheel ring gear and the passage of a zero reference pin. In alternative embodiments, sensor 6 reads a plurality of grooves, projecting pins or indentations in a reference face of the flywheel. The modulated signal so produced is used to read crank angle and instantaneous crankshaft angular velocity with a high degree of accuracy. Other alternative embodiments employ other magnetic and optical means for crankshaft motion sensing. In one such optical embodiment, laser energy is transmitted to the engine flywheel or other suitable rotating element by fibre-optic means and is reflected back by a plurality of 360 narrow mirrored segments separated by non-reflective surface through fibre-optic means to a suitable photosensitive device. To provide a basic ignition timing datum, a number one cylinder top dead centre reference is provided in the form of a pin or suitable projection on a rotating element of the camshaft, the passage of which is sensed by Hall Effect device 29. The signal so generated is fed to the logic circuitry 7 to provide a reference against which data gathered from flywheel sensor 6 is processed. A positional reference from the camshaft is required, in the case of a four-cycle engine, to differentiate between top dead centre of the compression stroke and top dead centre of the exhaust stroke. This is unnecessary in a two-cycle engine. In a further alternative embodiment in four-cycle engines, a random access memory in logic circuitry 7 and which is powered at all times, 'remembers' the position of the camshaft as the engine comes to rest at shutdown and fires the ignition pulses accordingly during startup. In yet another alternative embodiment, during startup, logic circuitry 7 randomly assumes that the next passage of top dead centre by number one piston will be on its firing stroke and generates firing impulses accordingly. If starting cranking is still in progress after a nominal number of pistons have passed top dead centre, logic circuitry 7 displaces firing impulses by 360 degrees of crankshaft rotation. If starting cranking is still in progress after the same nominal number of cylinders have passed top dead centre, logic circuitry 7 makes another 360 degree displacement of firing impulses, repeating this process until starting occurs.

Data transmitted from sensors 2, 3, 4, 5, 6, 29, 37 and 38 is processed in accordance with a program stored in logic circuitry 7 to generate command signals which are transmitted to laser energy generator 9 to control the timing, energy level and duration of laser energy pulses produced by that unit. The program by which logic circuitry 7 determines the timing and characteristics of the said laser pulses is derived from empirical data regarding the effect of the various variables sensed upon engine operation, in relation to the engine performance required. Power pack 8 powers laser energy generator 9, the output pulses of which are transmitted via fibre optic means 41 to optical distributor 40 and thence via individual fibre optic means 10 to individual engine combustion chambers. In an embodiment in engines possessing an even number of cylinders numbering four or more, individual cylinder fibre-optic means 10 for cylinders operating in phase are paired at a common distributed outlet of optical distributor 40, the distributed beam of which is divided by a suitable prism. In this arrangement, the number of distributed outlets of optical distributor 40 are reduced by half, and the output energy level of laser energy generator 9 is spiked such that one ignition pulse is provided for each cylinder as it approaches top dead centre on each of the compression and exhaust strokes. The measurement of instantaneous crankshaft angular velocity by sensor 6 enables a comparison to be made by logic circuitry 7 of the strength of individual power strokes of the engine. Where performance deficiencies in one cylinder are producing vibration, logic circuitry 7 is able to adjust the ignition timing, duration and intensity of individual ignition pulses to smooth out the said vibration.

Figure 2:
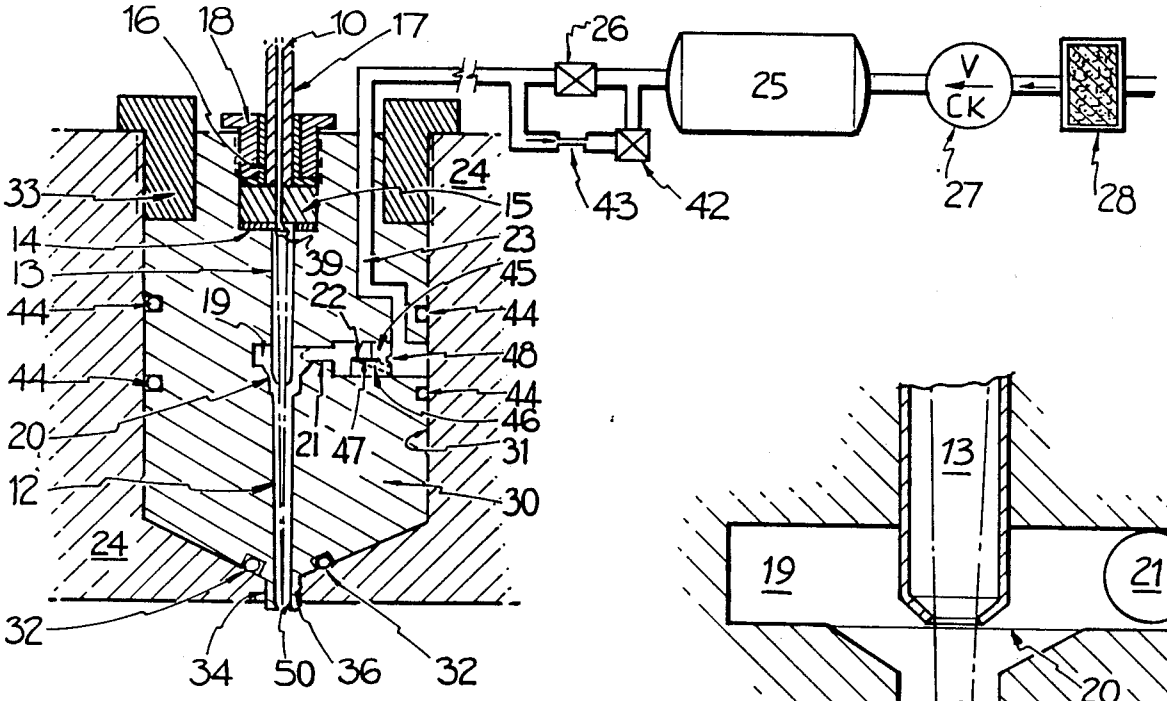
FIG. 2 is a longitudinal cross-sectional view of a preferred form of an air-purged duct through which laser energy is admitted to a combustion chamber.
Figure 3:
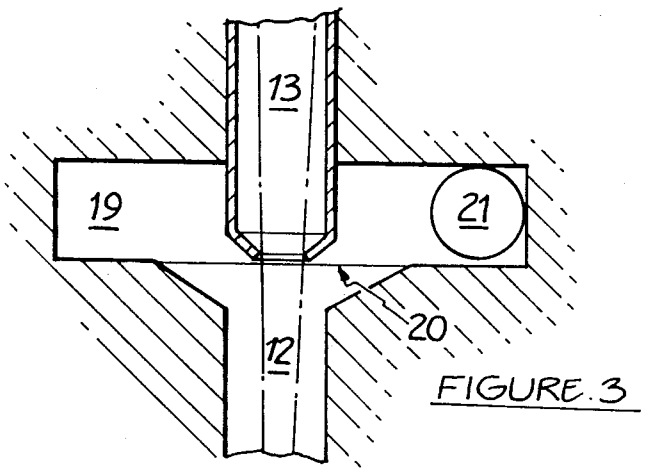
FIG. 3 is a diagrammatic view of a portion of the air purged duct depicted in FIG. 2.

According to FIG. 2, fibre-optic means 10 terminates in terminal block 15 of ceramic or other suitable heat-resistant material to which it is bonded. Fibre-optic means 10 is protected by sheath 17 which terminates securely in collar 16 bonded to terminal block 15. Terminal block 15 is seated in body part 30 in a gas-tight manner by means of gasket 14 and threaded collar 18. Body part 30 is accommodated in a light sliding fit in cylindrical recess 31 in cylinder head 24 in a gas tight manner by means of gasket 32 and threaded collar 33. The bottom of cylindrical recess 31 is conical in shape with a central opening 37 through which a short cylindrical extension 34 of body part 30 projects into combustion chamber 35. A restricted orifice 50 may be provided at the point of entry of the duct 12 into the combustion chamber 35 to minimise entry of gases into the chamber 35. Collinear with the final axis of fibre-optic means 10 is a focussing member such as lens 39 mounted at the head of duct 13. Duct 13 projects into plenum chamber 19 at the head of duct 12, in such a way as to create a narrow annular space 20 between the radiused entry of duct 13 to plenum chamber 19. The above described assembly will be referred to further herein as the purged duct unit. Laser energy emitted from the end of fibre optic means 10 is focussed by lens 39 to a point inside combustion chamber 35 where a breakdown spark occurs, initiating ignition. In certain applications the focussing angle may be significantly less acute than as illustrated in FIG. 2.

With reference to FIG. 2, duct 23 is connected in a disconnectable way to the purging air supply system and passes down body part 30 to meet lateral duct 21 leading to plenum chamber 19. The outer part of lateral duct 21 is made with an enlarged diameter which is threaded to screwably accommodate reed valve body 45. The inward part of reed valve body 45 is halved to produce a semi-cylinder, the remaining diametral face 47 of which is covered by reed 22, the inner end of which is fixed in a narrow slot in the said reed valve body. Air passage 46 is drilled obliquely through reed valve body 45 such that it emerges through the said diametral face beneath reed valve 22. Body part 30 is provided with suitable circumferential seals 44 positioned above and below lateral duct 21. The outer part of reed valve body 45 is provided with suitable slots or notches 48 by which it is screwed into lateral duct 21.

In the preferred embodiment of the invention, a single laser energy generator 9, as depicted in FIG. 1, transmits its output pulses via a form of distributor and thence via fibre optic means 10 to the purged duct units of individual combustion chambers. In an alternative embodiment, individual laser energy generators are provided for individual cylinders, such generators being separated from their purged duct units by short fibre optic means. In a further embodiment, fibre optic means 10, sheath 17, collar 16, terminal block 15 and threaded collar 18 are removed from the purged duct unit of each cylinder and a compact laser energy generator is screwed into the thread which normally accommodates threaded collar 18. The laser energy output pulses of the said laser energy generators are thus directed directly to lens 39 at the head of duct 13. In all cases, the said laser energy generator or generators are operated continuously at an output energy level below that required to effect ignition in the engine combustion chamber, with the output energy level spiked at the point where ignition is required.

Again in the preferred embodiment of the invention, carbon dioxide lasers are employed. In alternative embodiments, particularly those requiring a separate laser energy generator for each cylinder, laser diodes are employed. Experimentation has been undertaken to confirm that laser breakdown sparks satisfactory as a source of ignition for high speed internal combustion engines can be generated. This has shown that suitable breakdown sparks can be generated with laser pulse energies of from 5 to 200mJ and with pulse durations of between 100 psec and 50 nsec, the breakdown conditions being a function of gas pressure and pulse duration. Breakdown threshold was noted to decrease with increasing gas pressure, typically from 2MW at 15 PSI to 1.2MW at 100 PSI in nanosecond pulses. At 100 PSI gas pressure, breakdown threshold for picosecond duration pulses was a function of pulse duration and was found to be 25MW in 80 psec and 50MW in 300 psec. These last showed that the energy required was considerably lower when using the picosecond pulses, only about 2 to 5mJ being needed, in comparison with that needed for longer pulses. For example, when the pulse duration was 40 nsec, 60 to 80mJ was required to generate a spark. The breakdown sparks generated with an energy input of 80mJ and pulse duration of 50nsec were approximately 3 mm long and 0.3 mm wide. This is quite adequate for ignition purposes in a high speed piston engine.

Although the carbon dioxide laser is employed in the preferred embodiment of the invention, alternative embodiments employ lasers emitting different wavelengths. In one such embodiment, a lower energy level is required to achieve ignition by directing the laser energy into a groove or recess in the combustion chamber in which is trapped quench products from the preceding combustion cycle. The targeted hydrocarbon molecules are sufficiently excited to initiate an oxidising reaction. The wavelength of the laser energy so employed depends upon the fuel used in the engine. In another alternative embodiment, a small trap in the form of a pocket or recess is provided in the cylinder head in a position such that fuel droplets are captured during charging of the cylinder. An insufficiency of air during combustion generates a soot-rich environment in the said trap which is not completely purged during the subsequent exhaust and induction strokes. The laser energy is directed to the trap, targeting the soot particles which are made incandescent. In embodiments in which combustion products are targeted, an auxillary ignition system is provided for starting purposes employing high-tension spark discharge or glow plugs.

Further in the preferred embodiment of the invention, fibre-optic means 10, as depicted in FIG. 2, is of high-purity quartz. Such fibres have demonstrated an ability to transmit high-intensity coherent infra-red energy. Laser pulse beams from a neodymium/YAG laser at a wavelength of 1.06 microns and with an average power of 200 watts and peak power of 10 kW have been transmitted through such optical fibres with an energy loss of less than 2 percent. In an alternative embodiment, a 1mm square internal dimension metal waveguide, similar to that used to transmit microwave energy, is employed. Infra-red radiation within the waveguide is constrained to follow the waveguide because the electromagnetic field of the beam falls to zero at the conductor. Such a waveguide has shown an ability to transmit infra-red energy at 10 microns wavelength at an average energy level of 10 to 20 watts. Flexibility of metal waveguides currently available is limited to a bend radius of 18 inches. In a further alternative embodiment, optical fibres of polycrystalline metal halide are employed. Such fibres have demonstrated an ability to transmit infra-red laser energy at 10 microns wavelength and with an average energy level of 10 to 20 watts. In steel-jacketed form, these fibres will accept a bend of 4 inch radius without kinking. In another alternative embodiment, optical fibres are employed of extruded zinc selenide. Such fibres have exhibited an energy transmission capacity which makes them suitable for the invention. Those currently available, however, are somewhat limited in flexibility.

As depicted in FIG. 1, laser energy generated by laser energy generator 9 is transmitted via fibre-optic means 41 to optical distributor 40. In the preferred embodiment of the invention, optical distributor 40 comprises a single rotating mirror or prism by which the laser energy emitted from fibre-optic means 41 is reflected in turn to lenses at the ends of individual cylinder fibre-optic means 10. The rotation of the said mirror or prism is synchronised to that of the engine camshaft in the case of a four-cycle engine and the engine crankshaft in the case of a two-cycle engine, the output energy level of laser energy generator 9 being spiked as the beam of laser energy is brought into coincidence with the lenses at the ends of individual cylinder fibre-optic means 10. In an alternative preferred embodiment, optical distributor 40 comprises an electro-optic or acousto-optic deflector, the operating principles of which are well-known in the art. Where these devices are employed, a number of emergent beam positions is provided corresponding to the lenses at the ends of individual cylinder fibre-optic means 10. In a further embodiment, the laser energy emitted from the end of fibre-optic means 41 is reflected to the lenses at the ends of individual cylinder fibre-optic means 10 by means of a light-weight mirror which is vibrated by a piezo-electric translator, causing the reflected beam to scan across the said lenses. In yet another alternative embodiment, the output energy of laser energy generator 9 is transmitted through a number of Fabry-Perot cavity devices, the principle of which is well-known in the art. In this arrangement, the output of laser energy generator 9 is divided by prisms into one beam for each cylinder of the engine. The transmission of these beams to the lenses at the ends of individual cylinder fibre-optic means 10 is interrupted by the said Fabry-Perot cavity devices entering their non-transmission state. In an alternative embodiment of this last embodiment, the number of said prisms and Fabry-Perot cavity devices is halved for an engine with an even number of cylinders numbering four or more, the transmitted beam from each Fabry-Perot cavity device being divided by a further prism to direct beams to the paired lenses at the ends of individual cylinder fibre-optic means 10 of two cylinders operating in phase. The output energy level of laser energy generator 9 is spiked such that one ignition pulse is provided for each cylinder as it approaches top dead centre on each of the compression and exhaust strokes. In some cases it is convenient to delete fibre-optic means 41 and make optical distributor 40 such that it can directly accept the output energy of laser energy generator 9. In another embodiment, it may be appropriate to mount individual laser generating means such as laser diodes to supply directly each optic focussing means 39.

In operation, prior to starting the engine, at all times during its operation and for a timed period after it ceases to operate, plenum chamber 19 is kept pressurised by a supply of highly-filtered air. Plenum chamber 19 is circular in shape and air entering it does so through a tangential jet from passage 21, generating a high speed vortex within the said chamber. The air flow then passes down in passage 12 through the annular space 20 closely adjacent the outer wall whereby reverse flow up the passage 13 is substantially prevented. The said air is drawn from a suitable source to minimise the ingestion of contaminants, compressed to a pressure approximately equal to the highest cylinder pressure generated in the engine, passed through a highly-efficient filtering means 28 to remove any contaminant material and thence by way of non-return valve 27 to be stored in receiver 25 of suitable capacity. The first action of operating the engine starting controls opens solenoid valve 26, as depcited in FIG. 2, suitable interlock means then permitting operation of the engine starter. Pressurized air released from receiver 25 by solenoid valve 26 passes by way of duct 23, reed valve 22 and duct 21 to plenum chamber 19. In the preferred embodiment, the air compression means consists of a small, electrically operated reciprocation pump, the operation of which is controlled by a pressure switch referencing receiver air pressure. In an alternative embodiment, said air pump is mechanically-operated from the engine by means of an electromagnetic clutch and supported by an electrically-operated auxiliary. In all cases, a suitable pressure sensing device and interlock means prevents the operation of the engine starter if insufficient air pressure exists in receiver 25. Operation of the controls to stop the engine initiates a timed cycle during which a flow of air at reduced pressure is supplied through solenoid valve 42 and flow restrictor 43 to plenum chamber 19. During operation of the engine, a constant supply of air at a suitable pressure is supplied to plenum chamber 19. The pressure of the said air supply is maintained so that duct 12 is constantly purged of combustion products and, at the highest pressure generated in the cylinder, the flow of air out through duct 12 approximately ceases. The length of duct 12 is made so that under conditions of maximum deterioration of the air flow supply system, no combustion products can penetrate duct 12 to annular space 20. An interlock means is provided in all embodiments such that engine ignition will be interrupted if receiver air pressure drops below a minimal acceptable figure.

In alternative embodiments, more than one purged duct assembly is provided in each cylinder to provide multiple sources of ignition. In this embodiment the pulses of laser energy provided to the respective purged ducts may be either simultaneous or alternatively timed to achieve optimum combustion effects. In other alternative embodiments, two or more ignition pulses may be provided to each cylinder for each cycle, as the piston approaches TDC of the compression stroke to provide multiple points of ignition in a rapidly-rotating charge. Both these arrangements provide a greater ability to control flame propagation and other combustion characteristics to optimize performance of the engine. This use is impossible with conventional spark ignition systems due to their relative low spark repetition rates.

The claims defining the invention are as follows:

1. An ignition system for an internal combustion engine, said system including laser energy generating means for generating pulsed laser energy, control means for delivering a pulse of said laser energy at predetermined time intervals through a purging chamber to a combustion chamber of the internal combustion engine, said purging chamber having an opening communication with said combustion chamber through which said laser energy pulses are delivered, said purging chamber being provided with a supply of purging gas during operation of the engine, and means for concentrating said pulsed laser energy at a predetermined location within said combustion chamber, such that focussed laser energy formed by said means for concentrating the pulsed laser energy is sufficient to cause ignition of a combustible charge within said chamber.

2. An ignition system according to claim 1 wherein lens means forms the means for concentrating the pulsed laser energy.

3. An ignition system according to claim 1 wherein the laser energy generating means generates said pulsed laser energy continuously at an energy level below that required to effect ignition in the combustion chamber and the energy output of said laser energy generating means being spiked at each point in time when ignition is required.

4. An ignition system according to claim 1 wherein said purging gas is supplied to said purging chamber at a pressure that will enable gas flow from said purging chamber through said opening to said combustion chamber during at least a part of a complete operating cycle of the engine.

5. An ignition system according to claim 1 wherein a first passage is provided through which said laser energy pulses are delivered to said combustion chamber, said first passage terminating in opening located in said purging chamber, a plenum chamber forming part of said purging chamber and arranged upstream of said opening from said first passage, said plenum chamber including means for creating a vortex flow pattern of said purging gas from said plenum chamber in a downstream direction relative to the opening from said first passage.

6. An ignition system according to claim 4 or claim 5 wherein said purging gas is supplied to the purging chamber at a pressure substantially equivalent to or greater than a maximum combustion gas pressure generated within said combustion chamber.

7. An ignition system according to claim 1 wherein said purging gas is highly filtered and cleaned prior to delivery into the purging chamber.

8. An ignition system for an internal combustion engine, said system including laser energy generating means for generating pulsed laser energy pulses of desired level in timed sequence to a combustion chamber, said laser energy pulses being delivered to said combustion chamber through a purging chamber opening into said combustion chamber, said purging chamber having a continuous flow of purging gas supplied thereto during operation of the engine.

9. An ignition system according to claim 1 or claim 8 wherein two or more laser energy pulses are supplied to said combustion chamber for each operating cycle of the combustion engine.

10. An ignition system according to claim 1 or claim 8 wherein two or more of said purging chambers are provided leading to a said combustion chamber whereby one or more laser energy pulses are supplied therethrough for each operating cycle of the combustion engine.

11. An internal combustion engine comprising one or more combustion chambers and an ignition system according to claim 1 or claim 8.

12. An internal combustion engine according to claim 11 wherein a single said laser energy generating means is provided with distribution means arranged to transfer the generated laser energy pulses in timed sequence to said individual combustion chambers.

13. An internal combustion engine according to claim 11 wherein a said laser energy generating means is provided for each said combustion chamber.

* * * * *